US006978752B2

(12) United States Patent
Albertson et al.

(10) Patent No.: US 6,978,752 B2
(45) Date of Patent: Dec. 27, 2005

(54) HYBRID METAL-COMPOSITE VALVE LIFTER GUIDE

(75) Inventors: William C. Albertson, Clinton Township, MI (US); Mark Stabinsky, Troy, MI (US); Frederick J. Rozario, Fenton, MI (US); Jason E. Morehead, Waterford, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/830,946

(22) Filed: Apr. 23, 2004

(65) Prior Publication Data

US 2005/0235932 A1 Oct. 27, 2005

(51) Int. Cl.[7] ..... F01L 1/14

(52) U.S. Cl. ..... 123/90.5; 123/90.48; 123/90.15

(58) Field of Search ..... 123/90.5, 90.48, 123/90.15, 90.16, 90.51

(56) References Cited

U.S. PATENT DOCUMENTS 5,088,455 A * 2/1992 Moretz ..... 123/90.5
5,676,098 A * 10/1997 Cecur ..... 123/90.5
6,513,471 B1 * 2/2003 Hicks ..... 123/90.16

* cited by examiner

*Primary Examiner*—Thomas Denion
*Assistant Examiner*—Zelalem Eshete
(74) *Attorney, Agent, or Firm*—Christopher DeVries

(57) ABSTRACT

A hybrid valve lifter guide formed of metal and nonmetallic material for maintaining the angular position of a reciprocable valve lifter having a circumferential surface with at least one alignment flat. The guide includes a metal guide body having a longitudinal guide wall with at least one guide opening through the wall. The guide opening is adapted to receive a valve lifter. A nonmetallic insert is retained by the body adjacent the guide opening to engage at least one alignment flat of the valve lifter received in the guide opening to substantially maintain the angular position of the valve lifter and dampen angular oscillation of the lifter during engine operation.

17 Claims, 4 Drawing Sheets

HYBRID METAL-COMPOSITE VALVE LIFTER GUIDE

TECHNICAL FIELD

This invention relates to valve lifter guides for an internal combustion engine and, more particularly, to a guide assembly having a metal lifter guide with plastic inserts for dampening valve lifter oscillation and maintaining the angular position of roller hydraulic valve lifters within the engine.

BACKGROUND OF THE INVENTION

Engines with roller valve lifters require a valve lifter guide to maintain alignment between the roller of the valve lifter and an associated camshaft. For cost and assembly considerations, lifter guides are typically designed to accommodate multiple valve lifters on a common bank of cylinders. These guides are manufactured having straight-edged guide openings that engage flats on opposite sides of the lifters. With metal guides, the spacing of the opening edges is slightly larger than the valve lifter flats to avoid binding. However, tolerance variations can result in excessive clearance between the valve lifter and the metal guide, allowing a higher degree of valve lifter oscillation than desired.

One solution is to use valve lifter guides made of fully composite material to have a tight initial fit on the valve lifter flats. The composite guides take a "set" during engine break in which then results in good alignment without excessive friction load. This compliance and "set" in the composite lifter guide is predetermined and calibrated by the selection of constituents used to make up and process the composite material.

In some engines that use cylinder-deactivation with switching valve lifters, fully composite valve lifter guides are impractical due, for example, to space limitations in the engines and high initial drag. In this case, metal construction valve lifter guides are the only practical choice.

SUMMARY OF THE INVENTION

The present invention provides a hybrid valve lifter guide formed of metal and nonmetallic material for dampening valve lifter oscillation and maintaining the angular position of a roller valve lifter while overcoming the limitations of the prior art. Specifically, the valve lifter guide may be used with any type of internal combustion engine, including engines with space limitations and switching lifters for cylinder deactivation.

In an exemplary embodiment, the hybrid valve lifter guide is designed to accommodate multiple hydraulic switching valve lifters in a push rod type internal combustion engine with cylinder deactivation. Each valve lifter has a generally cylindrical body having upper and lower ends. A lost motion spring extends from the upper end and a roller cam follower bearing is attached to the lower end of the valve lifter. Four axially-extending flats are machined into the circumferential surface of each valve lifter at 90 degree intervals. The flats provide guiding surfaces adapted to engage the guide to prevent excessive angular rotation of the valve lifters during engine operation.

The valve lifter guide has a metal guide body having a longitudinal guide wall with multiple guide openings, extending through the wall, each adapted to receive a valve lifter as described above. The guide body may have upturned stiffening side rails extending from laterally opposite sides of the guide wall. A nonmetallic insert is retained by the guide body adjacent each guide opening to engage at least one alignment flat of a valve lifter received in each guide opening to dampen valve lifter oscillation and maintain the angular position of the valve lifter within the guide opening.

In an exemplary embodiment for an engine having two valves per cylinder, the guide openings are arranged in pairs having longitudinally adjacent ends separated by a laterally extending cross member. Each guide opening is further defined by a by a bulbous end portion spaced longitudinally from the cross member and a pair of laterally-spaced straight edges extending longitudinally between the cross member and the bulbous end portion. The edges of the guide openings are adapted to engage opposite flats of valve lifters received within the guide openings.

In one exemplary embodiment, the insert is formed of glass filled nylon and has first and second ends joined by opposite sidewalls adapted to engage flats of adjacent valve lifters. The insert has a generally C-shaped cross section internally defining a retaining channel adapted for attachment to the cross member.

In an alternative embodiment, protrusions extend from the first and second ends of the insert to snap into openings or recesses in the upturned side rails of the lifter guide.

When a pair of valve lifters are received within a pair of guide openings, one flat of each valve lifter engages an adjacent sidewall of the insert, retained at the adjacent ends of the guide openings. Also, a pair of oppositely facing flats of each valve lifter adjacent the insert are positioned to engage the straight edges of their respective guide openings. The engagement between the flats of the valve lifters and the edges of the guide openings and sidewalls of the insert dampen valve lifter oscillation and maintain the angular position of the valve lifters as they reciprocate within the guide openings.

If desired, additional inserts may be attached to the lifter guide oppositely spaced from the adjacent ends of the guide openings, so that a sidewall of each of the additional inserts engages a fourth flat of an associated valve lifter spaced away from the adjacent ends of each pair of guide openings. The additional inserts provide each valve lifter with a fourth guide, which further improves the lifter guides ability to dampen valve lifter oscillation and maintain the angular position of the valve lifters as they reciprocate within the guide openings.

These and other features and advantages of the invention will be more fully understood from the following description of certain specific embodiments of the invention taken together with the accompanying drawings.

DESCRIPTION OF THE PREFERRED EMBODIMENT

Figure 1:
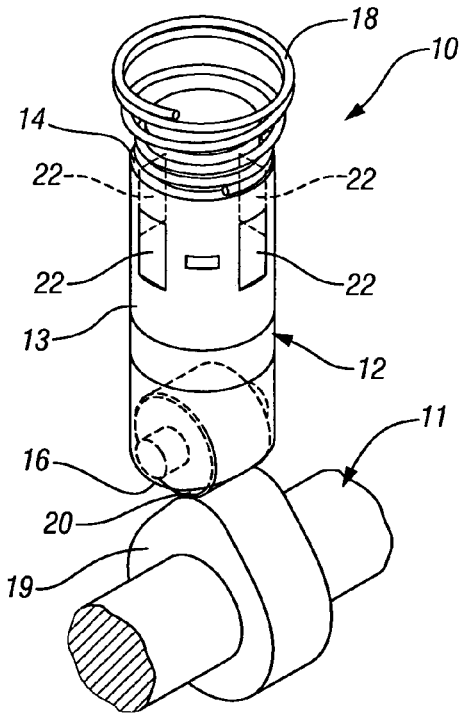
FIG. 1 is a pictorial view of a switching valve lifter shown adjacent an associated cam.

Referring first to FIG. 1 of the drawings in detail, numeral 10 generally indicates a switching type valve actuating assembly including a camshaft 11 and a hydraulic switching valve lifter 12 as used in a push rod type internal combustion engine. The valve lifter 12 has a generally cylindrical body 13 having upper and lower spaced ends 14, 16. A lost motion spring 18 extends from the upper end 14 of the valve lifter to urge the valve lifter against a cam 19 during cylinder deactivation. A cam follower roller 20 is mounted in the lower end 16 of the valve lifter 12 to minimize friction between the valve lifter and an associated cam 19. Four axially extending flats 22 are machined into the circumferential surface of the cylindrical body 13 at 90 degree intervals. The flats 22 form guiding surfaces to maintain the angular relation of the valve lifter 12 to the cam 19 during engine operation.

Figure 2:
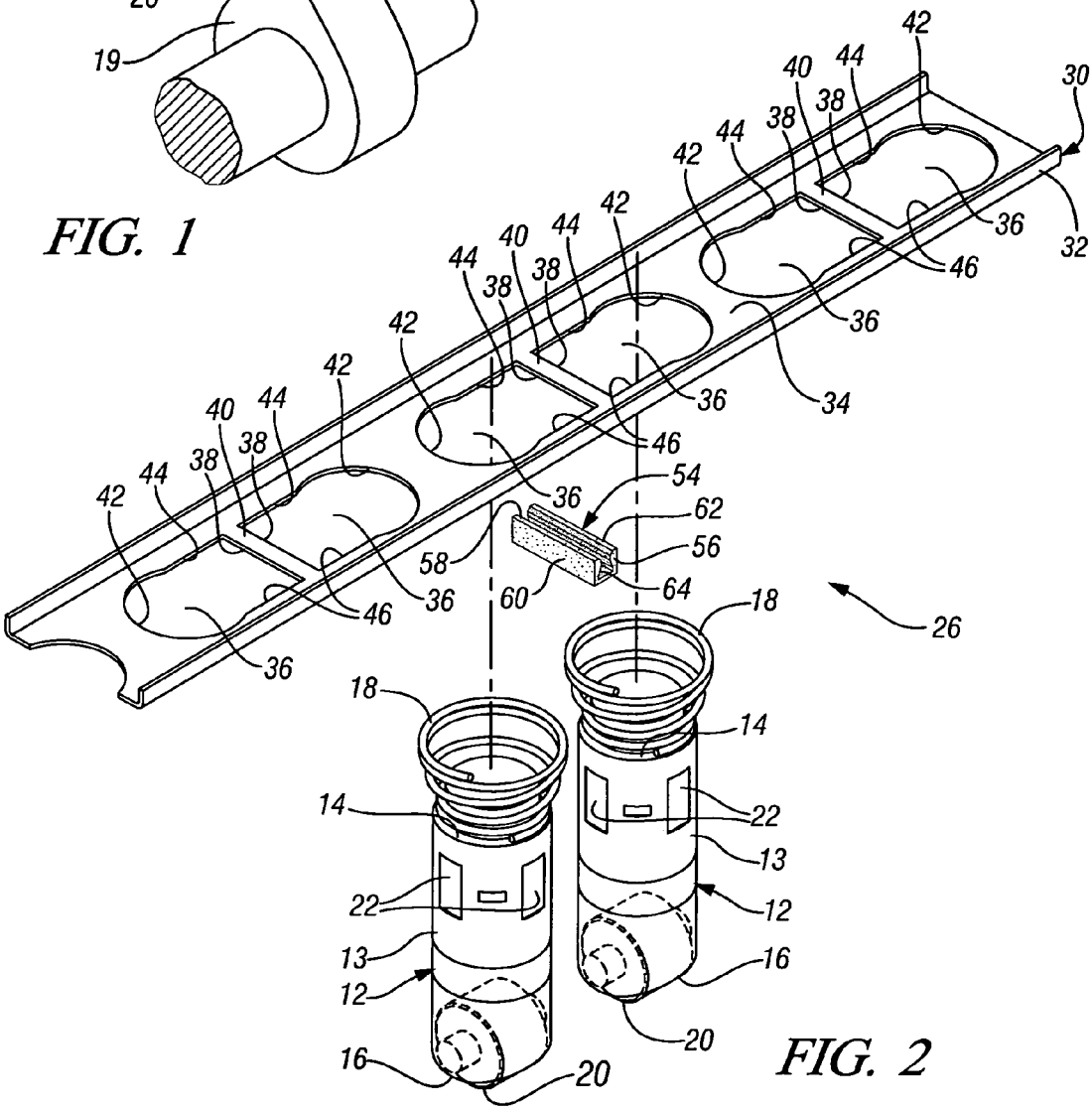
FIG. 2 is an exploded pictorial view of a valve lifter and guide assembly according to the present invention.

FIG. 2 shows a valve lifter and guide assembly 26 including a plurality of switching valve lifters 12 retained in a valve lifter guide 30. The lifter guide 30 includes a metal guide body 32 having a longitudinal guide wall 34 with guide openings 36 arranged in spaced pairs. The openings 36 of each pair have longitudinally adjacent ends 38 separated by a laterally extending cross member 40. The guide openings 36 are further defined by bulbous end portions 42 spaced longitudinally from the cross members 40 and pairs laterally spaced straight edges 44, 46 extending longitudinally between the cross members and the bulbous end portions. The edges 44, 46 act as guides, which engage opposite flats 22 of the valve lifters 12. The metal guide body also has a pair of upturned side rails 48, 50 extending from laterally opposite sides of the guide wall 34. If desired, the metal guide body 32 may be hardened to improve resistance to scuffing and wear.

The valve lifter guide 30 also includes a plurality of elongated inserts 54, only one being shown. Inserts 54 are formed of nonmetallic material such as plastic or glass filled nylon. The inserts have spaced ends 56, 58 connected by sidewalls 60, 62, which engage one of the flats 22 of the valve lifters. Each insert 54, has a generally C-shaped cross section internally defining a retaining channel 64 adapted for receiving one of the cross members 40.

The lifter guide 30 is assembled by first snapping the inserts 54 over the cross members 52, which are received in the retaining channels 64, to form the valve lifter guide assembly 26. Valve lifters 12 are then inserted into the bulbous end portions 42 of guide openings 36. The valve lifters 12 are then slid toward their adjacent cross member 40 so that one of the flats 22 of the valve lifters 12 engages a sidewall 60 or 62 of each insert 54 and adjacent oppositely positioned flats 22 of the valve lifters 12 engage with clearance the edges 44, 46 of the guide openings 36.

After the valve lifters 12 and guide assembly 26 are completed, the assembly may be installed within an engine block, not shown. When the assembly 26 is installed in the engine block, the lower ends 16 of the valve lifters 12 fit into bores beneath the valve lifter guide assembly and the rollers 20 engage cams of an associated camshaft, not shown.

During engine operation, rotation of a camshaft 11 causes the cams 19 to reciprocate the valve lifters 12 within the guide openings 36 for valve train actuation. Depending on the speed of valve lifter reciprocation, the lost motion spring 18 may cause the valve lifters 12 to oscillate angularly, thereby placing angular loads on the inserts 54 and the edges 44, 46 of the guide openings 36.

As the valve lifters 12 oscillate within the guide openings 36, the inserts 54 initially absorb the oscillations and the angular loads of the valve lifters 12 to minimize the loads exerted on the edges 44, 46. When the load exerted by the valve lifters 12 increases sufficiently, as at high engine speeds, the inserts will yield and allow oscillations of the valve lifters 10 to exert increased force against the edges 44, 46 of the guide openings 36. However, the inserts still act to dampen the oscillations and angular loads exerted by the lifters 12 and reduce the load exerted on the edges 44, 46 of the guide openings 36.

Since the lifter guide 30 and the edges 44, 46 are formed of metal, the edges are able to resist greater rotational loads than the inserts 54. Thus, the edges 44, 46 resist the increased rotational loads exerted by the valve lifters 12 and maintain the angular positions of the valve lifters 12 relative to their respective cams 19.

It is preferred, that the inserts 54 should have a tight initial fit around the valve lifters 12 and take a "set" during engine break in. The compliance and "set" of the inserts 54 is predetermined and calibrated by the selection of constituents used to make up and process the inserts. Preferably, the predetermined "set" should maintain a tight tolerance between the insert 54 and an associated valve flat 22 to maintain good alignment of the valve lifters 12 without exerting excessive resistance to restrict the movement of the valve lifters.

Figure 3:
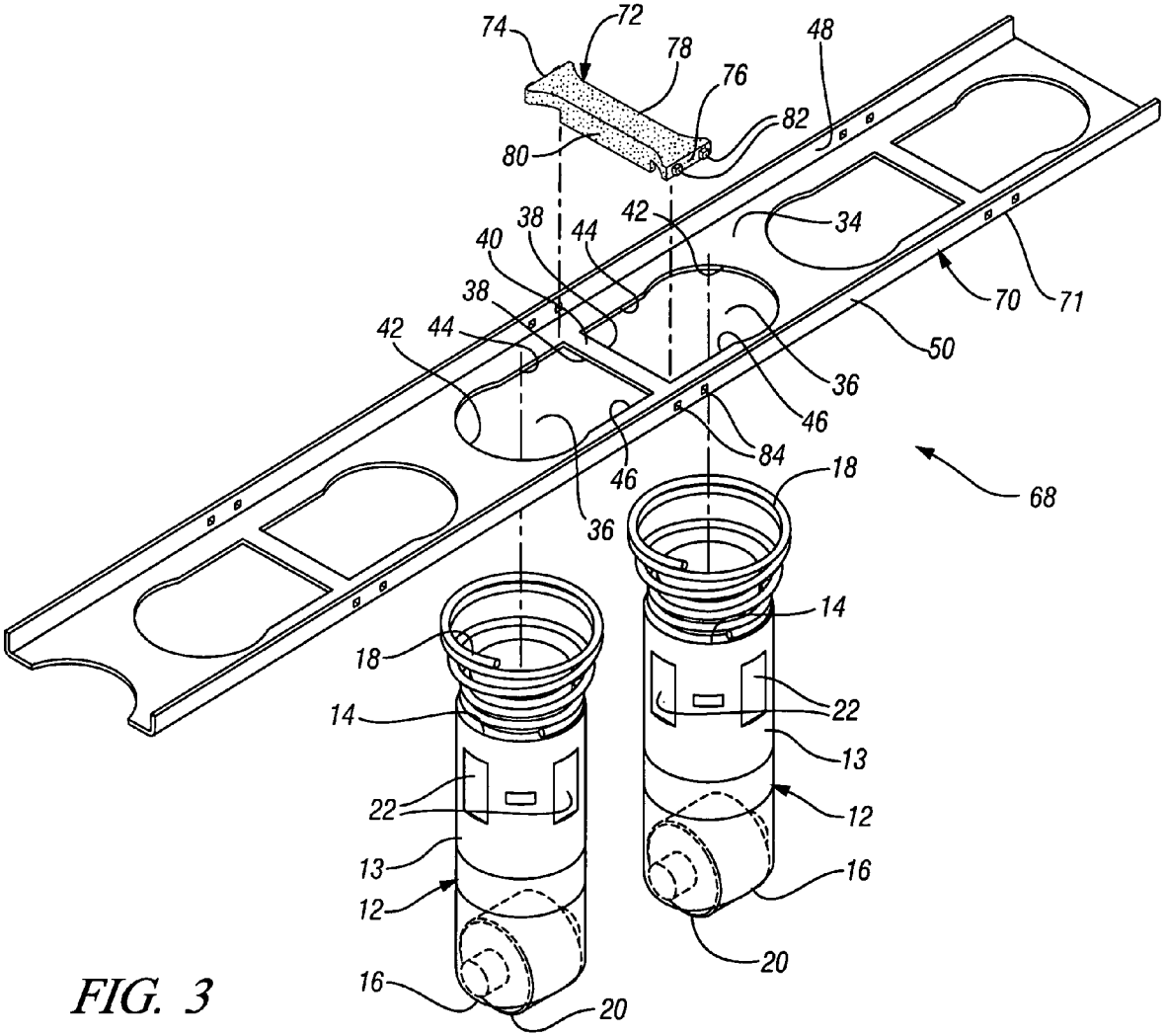
FIG. 3 is a view similar to FIG. 2 showing an alternative embodiment of valve lifter guide assembly.

FIG. 3 illustrates a valve lifter and guide assembly 68 having a plurality of switching valve lifters 12 retained in an alternative valve lifter guide 70 similar to lifter guide 30, wherein like numerals indicate like parts. Lifter guide 70 has a metal guide body 71 like that of lifter guide 30 in having a longitudinal guide wall 34 with guide openings 36 arranged in pairs having longitudinally adjacent ends 38 separated by a laterally extending cross member 40. The guide openings 36 again include bulbous end portions 42 spaced longitudinally from cross members 40 and pairs of laterally spaced straight edges 44, 46 extending longitudinally between the cross members and the bulbous ends. The edges 44, 46 act as guides, which engage opposite flats 22 of the valve lifters 12. The metal guide body also has a pair of upturned side rails 48, 50 extending from laterally opposite sides of the guide wall 34. If desired, the metal guide body 32 may be hardened to improve resistance to scuffing and wear.

The valve lifter guide 70 also includes a plurality of elongated inserts 72, only one being shown. Inserts 72 are formed of nonmetallic material such as plastic or glass filled nylon. The insert 72 have spaced ends 74, 76 connected by sidewalls 78, 80 engaging the flats of the valve lifters 12. Protrusions 82 extend from the ends 74, 76 of the insert 72. The protrusions 82 are adapted to be snapped into openings or recesses 84 provided in the side rails 40, 42.

The guide 70 is assembled by first attaching inserts 72 to the lifter guide body 71 by snapping the protrusions 82 of the inserts 72 into the recesses 84 of the rails 40, 42. After the inserts are attached to the lifter body 71, valve lifters 12 are placed in the guide 70 to form the lifter and guide assembly 68. The valve lifters 12 are inserted into the bulbous ends 42 of the guide openings 36. The lifters 12 are then subsequently slid toward their adjacent cross members 40 so that one of the flats 22 of each valve lifter 12 engages one of the sidewalls 78, 80 of the associated insert 72 and adjacent oppositely positioned flats 22 of the valve lifter engage with clearance the edges 44, 46 of the guide openings 36.

The lifter guide assembly 68 and the valve lifters 12 retained within the guide openings 36 are then installed within an engine block, not shown. When the assembly 68 is installed in the engine block, the lower ends 16 of the valve lifters 10 fit into bore beneath the valve lifter guide to engage cams of a camshaft, not shown.

The operation of guide assembly 68 is similar to the operation of guide assembly 26 as explained above.

Figure 4:
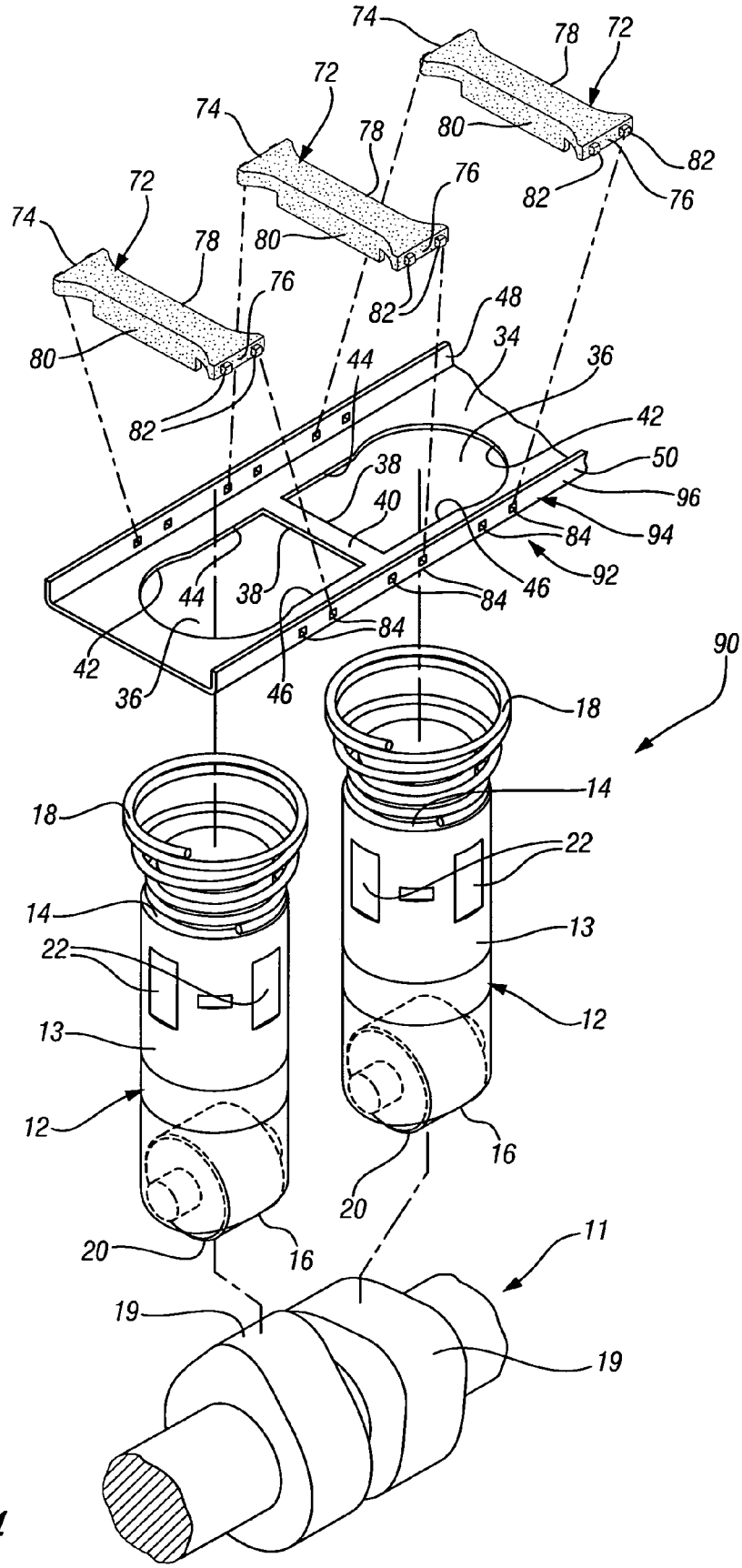
FIG. 4 is a view similar to FIG. 3 showing a variation of the valve lifter guide assembly of FIG. 3.
Figure 5:
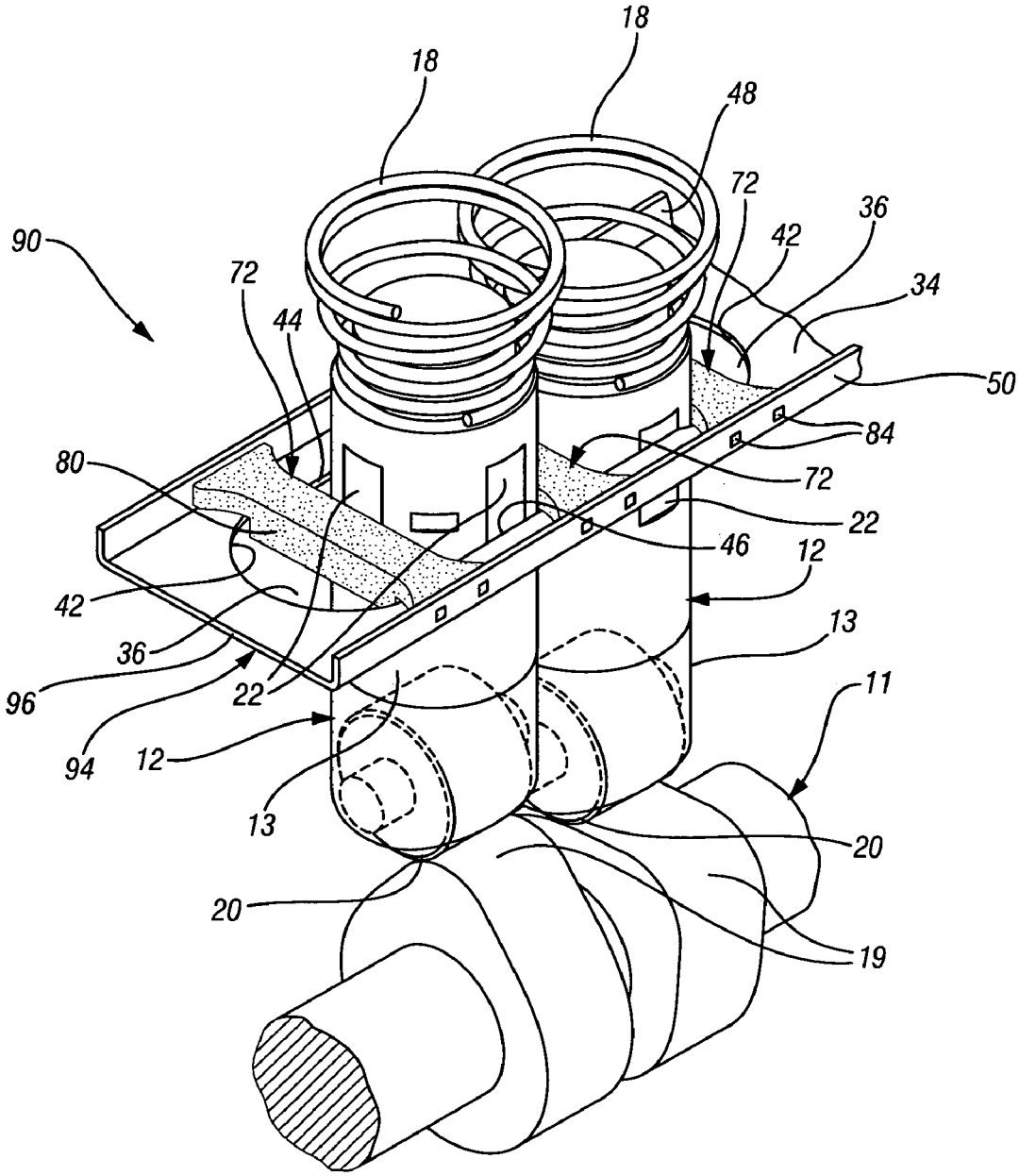
FIG. 5 is a pictorial view of the valve lifter and guide assembly of FIG. 4 together with an associated camshaft.

Referring now to FIGS. 4 and 5, a fragmentary portion of an engine 90 is shown in exploded and assembled conditions, respectively. Engine 90 includes a camshaft 11 with cams 19 engaged by switching valve lifters 12 of a valve lifter and guide assembly 92. Assembly 92 includes an alternative valve lifter guide 94 similar to lifter guide 70, wherein like numerals indicate like parts. Guide 94 has a metal guide body 96 having a longitudinal guide wall 34 with guide openings 36 arranged in pairs having longitudinally adjacent ends 38 separated by a laterally extending cross member 40. The guide openings 36 are further defined by bulbous end portions 42 spaced longitudinally from cross members 40 and a pair of laterally spaced straight edges 44, 46 extending longitudinally between the cross members and the bulbous ends. The edges 44, 46 act as guides, which engage opposite flats 22 of the valve lifters 12. The metal guide body 96 also has a pair of upturned side rails 48, 50 extending from laterally opposite sides of the guide wall 34. If desired, the metal guide body 96 may be hardened to improve resistance to scuffing and wear.

The valve lifter guide 94 also includes elongated inserts 72, formed of nonmetallic material such as plastic or glass filled nylon. The inserts 72 have spaced ends 74, 76 connected by opposite sidewalls 78, 80 adapted to engage flats of the valve lifters 12. Protrusions 82 extend from the ends 74, 76 of the inserts 72. The protrusions 82 are adapted to be snapped into openings or recesses 84 provided in the side rails 40, 42.

The guide 94 is assembled by first attaching inserts 72 to the guide body 96, adjacent the cross members 40, by snapping the protrusions 82 of the inserts 72 into the recesses 84 of the rails 40, 42. After the inserts are attached to the lifter guide body 96, valve lifters 12 are inserted into the bulbous ends 42 of the guide openings 44. The valve lifters 12 are then slid toward the cross member 40 so that one of the flats 22 of each valve lifter 12 engages one of the sidewalls 78, 80 of the inserts 72 and adjacent oppositely positioned flats 22 of the valve lifters engage edges 44, 46 of the associated guide openings 36.

Additional inserts 72 are then attached to the guide body 96 by snapping the protrusions 82 of the inserts 72 into additional recesses 84 spaced a distance from the cross members 40 so that the inserts are positioned adjacent the fourth flats 22 of the valve lifters retained within the guide openings 36 to enclose the valve lifters within the guide openings 36, and complete the lifter and guide assembly 92.

The guide assembly 92, with the valve lifters 12 is then installed in an engine block, not shown. When the guide assembly 92 is installed in the engine, the lower ends 16 of the valve lifters 12 extend into bores beneath the valve lifter guide assembly and the rollers 20 engage their respective cams 19.

Guide assembly 92 operates similarly to guide assembly 26, except that the additional inserts 72 increase the ability of the guide to dampen oscillation of the valve lifters 12. Further, the additional inserts 72 retain the valve lifters within the guide openings 36 before the guide assembly 92 and its valve lifters 12 are installed in an engine. If the rotational loads of the valve lifters 12 become excessive, the inserts 72 on opposite sides of the valve lifters may give, while still dampening the oscillating loads of the valve lifters, to allow the edges 44, 46 to limit the rotational movement of the valve lifters 12 and maintain the angular relationship between the roller bearings 20 and their respective cams 19.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve lifter guide for use with an internal combustion engine for maintaining the angular position of a reciprocable valve lifter having a circumferential surface with at least one axially extending alignment flat, the guide comprising:

a metal guide body having a longitudinal guide wall with at least one guide opening through the wall and adapted to receive a valve lifter; and a nonmetallic insert extending laterally across the guide wall and retained by the guide body adjacent a longitudinal end of the guide opening, the insert positioned to engage the at least one alignment flat of a valve lifter received in the guide opening to thereby substantially maintain the angular position of the valve lifter in the guide.

2. A valve lifter guide as in claim 1 wherein the insert is formed of plastic.

3. A valve lifter guide as in claim 2 wherein the plastic is glass filled nylon.

4. A valve lifter guide as in claim 2 wherein the guide body includes upturned side rails extending from laterally opposite sides of the guide wall.

5. A valve lifter guide as in claim 4 wherein the at least one guide opening is defined by a pair of longitudinally extending laterally spaced edges adapted to engage opposite flats of a valve lifter.

6. A valve lifter guide as in claim 4 wherein the guide openings are arranged in pairs having longitudinally adjacent ends and said insert extends laterally across said ends of each pair of guide openings to engage at least one flat of each valve lifter.

7. A valve lifter guide as in claim 3 wherein the insert is adapted to take a set during operation in an engine to maintain a tight tolerance between the insert and a flat of an associated valve lifter.

8. A valve lifter guide as in claim 6 including an insert extending laterally across the guide spaced a distance from the longitudinally adjacent ends of the pair of guide openings to engage at least one flat of an associated valve lifter.

9. A valve lifter guide as in claim 4 including an insert extending laterally across the guide spaced a distance from the longitudinal end of the guide opening to engage at least one flat of an associated valve lifter.

10. A valve lifter guide as in claim 6 wherein the insert is retained by a cross member extending between the ends of each pair of guide openings.

11. A valve lifter guide as in claim 6 wherein the insert is snapped between the upturned side rails and retained by a cross member extending between the ends of each pair of guide openings.

12. A valve lifter guide as in claim 8 wherein the insert is snapped between the upturned side rails.

13. A valve lifter guide as in claim 9 wherein the insert is snapped between the upturned side rails.

14. A valve lifter guide as in claim 1 wherein the valve lifter is a switching valve lifter.

15. A valve lifter guide as in claim 6 wherein the valve lifter is a switching valve lifter.

16. A valve lifter and guide assembly for an internal combustion engine, the assembly comprising:

a valve lifter guide as defined in claim 1; and a roller valve lifter retained in each guide opening of the guide, each lifter having an alignment flat engaging the nonmetallic insert of the associated guide opening.

17. A valve lifter and guide assembly for an internal combustion engine, the assembly comprising:

a valve lifter guide as defined in claim 6; and a roller valve lifter retained in each guide opening of the guide, each lifter having an alignment flat engaging the nonmetallic insert of the associated guide opening.

* * * * *